United States Patent [19]

Stinchfield

[11] 4,109,960

[45] Aug. 29, 1978

[54] LEGLESS ROCKER-RECLINER CHAIR

[76] Inventor: Lawrence M. Stinchfield, 539 Beverly Ave., Paso Robles, Calif. 93446

[21] Appl. No.: 802,649

[22] Filed: Jun. 2, 1977

Related U.S. Application Data

[63] Continuation-in-part of Ser. No. 746,476, Dec. 1, 1976, abandoned.

[51] Int. Cl.[2] ..... A47C 3/02

[52] U.S. Cl. ..... 297/258; 297/411; 297/421

[58] Field of Search ..... 297/258, 270, 272, 411, 297/421

[56] References Cited

U.S. PATENT DOCUMENTS

| | | | |
|---|---|---|---|
| 2,785,733 | 3/1957 | Witty | 297/258 |
| 3,451,672 | 6/1969 | Kazdan | 272/56 X |
| 3,620,570 | 11/1971 | Wilson et al. | 297/458 X |

FOREIGN PATENT DOCUMENTS

| | | | |
|---|---|---|---|
| 1,491,608 | 8/1967 | France | 297/258 |
| 1,959,100 | 6/1971 | Fed. Rep. of Germany | 297/258 |
| 6,712,562 | 3/1968 | Netherlands | 297/258 |

*Primary Examiner*—James C. Mitchell
*Attorney, Agent, or Firm*—Thomas Schneck, Jr.

[57] ABSTRACT

A legless chair possessing an arcuate exterior permitting rocking and reclining. The arcuate surface contacts a floor for stability and reclining to a selected position. Weight in the nose of the chair brings the chair to an upright position when not in use. A lightweight filler material may be provided for buoyancy, easy portability and for use in water.

6 Claims, 7 Drawing Figures

LEGLESS ROCKER-RECLINER CHAIR

CROSS-REFERENCE TO RELATED APPLICATION

This application is a continuation-in-part of Ser. No. 746,476 filed Dec. 1, 1976, now abandoned.

BACKGROUND OF THE INVENTION

1. Field of the Invention.

This invention relates to rocking chairs and more specifically to chairs that possess a rocking and reclining capability due to suitable seat structure rather than to externally appended rocking and reclining elements.

2. Prior Art.

The prior art reveals certain types of chairs with a rocking or reclining capability.

A first type is the more conventional and comprises a seat attached to a pair of rocking elements. This type of rocking chair is exemplified by U.S. Pat. Nos. 89,317; 3,072,435 and 3,526,429.

A second type of chair is one in which the rocking motion is made possible by a suitably molded outer contour of the seat itself. This type of chair is exemplified by U.S. Pat. Nos. 3,451,672; D196,430 and D210,453.

Most simple, lightweight chairs that have the ability to rock have certain disadvantages. They may not be upright when not in use, thereby using more floor space, or tip over when rocked too vigorously and, if placed on an irregular or graded surface, may become unsteady.

A third type of chair has a molded outer contour of the seat giving it a rocking and reclining capability and a weight in the base of the chair for upright stability, for example see Netherlands patent application 6,712,562 (1968) or French Pat. No. 1,491,608 (1967).

It is an object of this invention to provide a lightweight rocking chair of enchanced stability. It is a further object of this invention to provide a chair that is adapted to recline to a position selected by a user and remain in the reclining position without significant effort on the part of the user. It is yet another object of this invention to make a lightweight chair rugged of construction, easily portable and simple of manufacture.

SUMMARY OF THE INVENTION

The above objects have been satisfied by a legless chair with a body molded sitting surface which maximizes comfort and stable positioning of the user, and an arcuate outer surface for rocking and reclining. Weight in the nose of the chair, either at the forward edge of the sitting surface, or in forwardly extending arms, keeps the chair upright when not in use.

When placed upon a flat surface the present chair, due to its balanced design, will recline to a stable and comfortable position with a slight force applied by a user and will maintain the stable position. Alternatively, a user may rock the chair.

The present chair may be made of buoyant materials, such as foam, so it may be used as a balanced floatable chair for use in pools, lakes or the like. The chair may be covered with padding and a cover to increase comfort and durability.

DESCRIPTION OF THE PREFERRED EMBODIMENT

Figure 1:
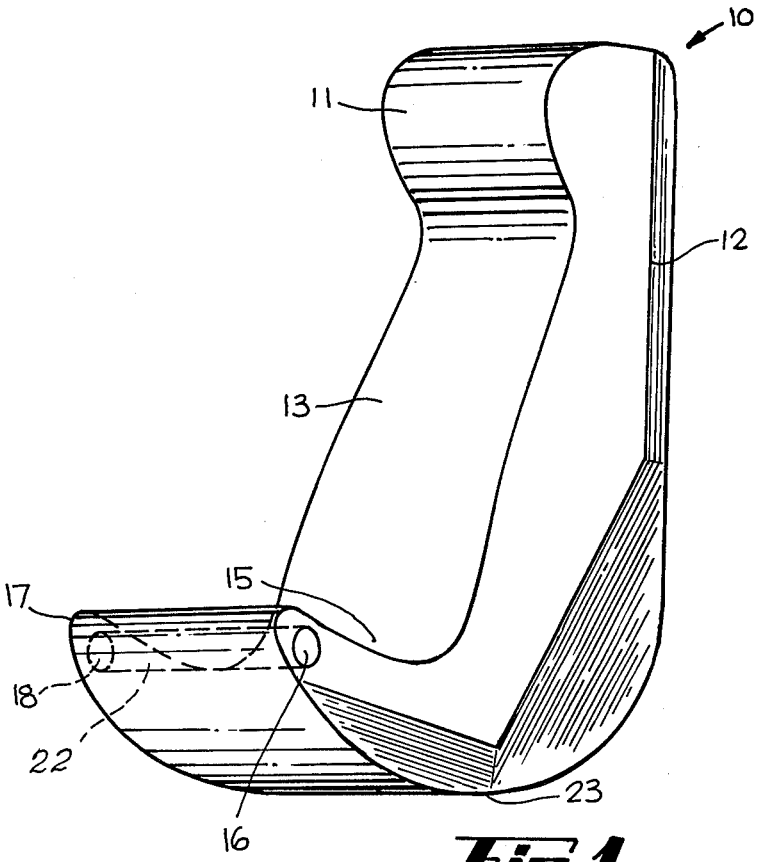
FIG. 1 is a perspective view of the legless rocker-recliner chair of the present invention.
Figure 2:
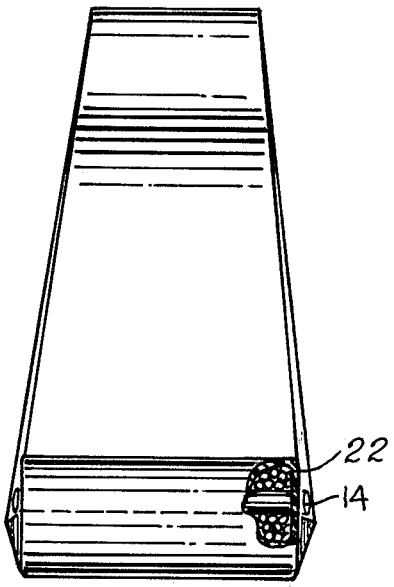
FIG. 2 is a partially cutaway front view of the apparatus of FIG. 1.
Figure 3:
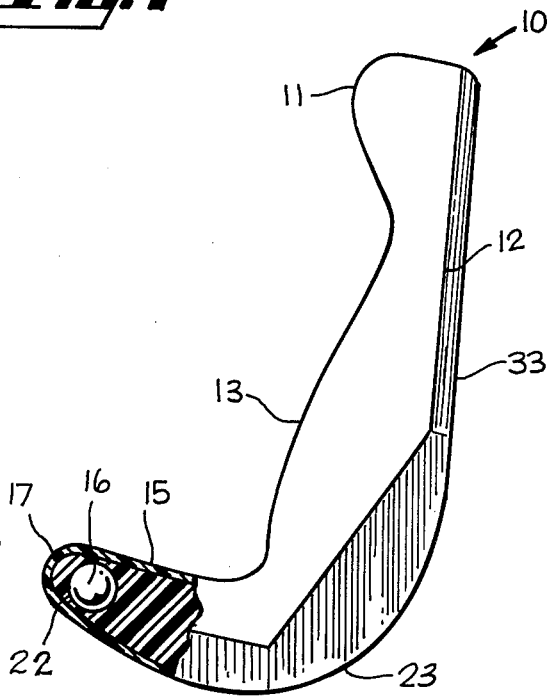
FIG. 3 is a partially cutaway side view of the apparatus of FIG. 1.

FIGS. 1, 2 and 3 show a preferred embodiment of the chair of the present invention. A main body 10 defines the overall configuration of the chair. Body 10 may be of unitary construction or it may be manufactured in parts, such as the two body parts on each side of line 12, and assembled into the structure shown, by cementing together the two body parts on each side of line 12.

The inner or user surface of body 10 of this present invention is divided into three major regions, including the head supporting region 11, the back supporting region 13, and the seat supporting region 15. Head supporting region 11 is formed to create a natural headrest shape and is generally more bulbous than the back supporting area 13. Seat supporting region 15 may be rimmed on three of its sides by slightly raised areas and on its fourth side by the terminal end of back support area to form a depressed central region supporting buttocks of a user. Such raised areas should be smooth extensions of the edges of back support area.

Head supporting region 11, back support region 13 and seat supporting region 15 form a molded seat which generally conforms to the natural contours present in the user's neck, spine and buttocks. This results in a very comfortable and relaxing support. Additionally, due to the contoured seat molding of the chair, the user may position himself in a desired reclining position with slight effort, i.e. a few pounds of force.

Arcuate rocking region 23 is the prominent outer chair surface and extends as a smooth curve opposite the inner surface and connected thereto forming a closed chair body. It is arcuate region 23 that lends the chair its ability to rock and recline. This region comes directly into contact with a rocking or reclining surface, i.e. a floor. In the present chair, a user may seat himself in a reclining position with the back of the chair making an angle of 60°, or more, with the vertical. When the user alights from the chair it will come to an upright position because of weight disposed in the nose of the chair. Such weight may be internal to the forward portion of the seat structure, or in arms above the seat.

Body 10 may be provided with a cylindrical shaft 22 which traverses the width of the chair in raised area 17 of the nose of the chair. Inserted into shaft 22 is a steel chair balancing bar 14 which serves as a counter balance weight in the nose of the chair. Caps 16 and 18 serve to retain bar 14 within shaft 22 and further serve protective and decorative functions. The important function performed by balancing bar 14 is to bring the chair to an upright position when it is not in use, thereby yielding useable floor space. This invention does not restrict itself to a particular shape of the balancing bar, but may use alternate but functionally equivalent weights for maintaining chair balance. For example, one or more discrete weights, such as balls, could be placed in shaft 22 or at other locations, so long as the discrete weights are held in place.

It has been found that a weight equal to one half the total chair weight is suitable. For maximum leverage, the bar is placed at the extremity of raised area 17, next to the intended position for a user's legs. This position helps the chair maintain a low center of gravity. As an alternative to a bar, a ball weight in the center of shaft 22 may be used. The same position is used, i.e. near the joinder of inner and outer chair surfaces.

Balancing bar 14 maintains the chair upright when not in use, as opposed to a reclining position. For example, if four pounds of foam filler are used in chair body 10, a two pound bar 14 will keep the chair upright, as shown in FIG. 1.

Main body 10 may be made of a wide variety of materials. In this preferred embodiment main body 10 is made of foam, blown into a mold which creates a main body which is comfortably resilient, lightweight and easy of manufacture. However, many other suitable lightweight materials exist for making main body 10 including naturally occurring substances such as soft wood or cork, or a wide variety of plastics or resins. Preferably, the filler material should have a density less than water for flotation and ease of carrying, i.e. to have lightweight properties.

Main body 10 of the present invention is of solid construction, but need not be restricted to such. An alternate construction comprises a hollow shell of some suitably formed manufactured material such as fiberglass or lightweight aluminum.

The surface of main body 10 may be covered with resilient padding, extending from head supporting region 11 down to raised area 17. This resilient padding adds to the comfort of the user but does not constitute a functionally necessary portion of the present invention.

FIG. 3 shows a sideview of the chair of the present invention wherein a high impact styrene coating 33 has been applied to the outer surface 23 of the chair. The styrene coating is approximately 0.080 inches thick and serves to distribute stresses on the chair and add strength. As an alternative to the styrene coating, other types of plastic coatings may be adhered to the outer surface of the chair for the same purpose. A fabric covering may be applied in contact with the inner and outer surfaces of the chair for decorative, as well as functional purposes.

Figure 4:
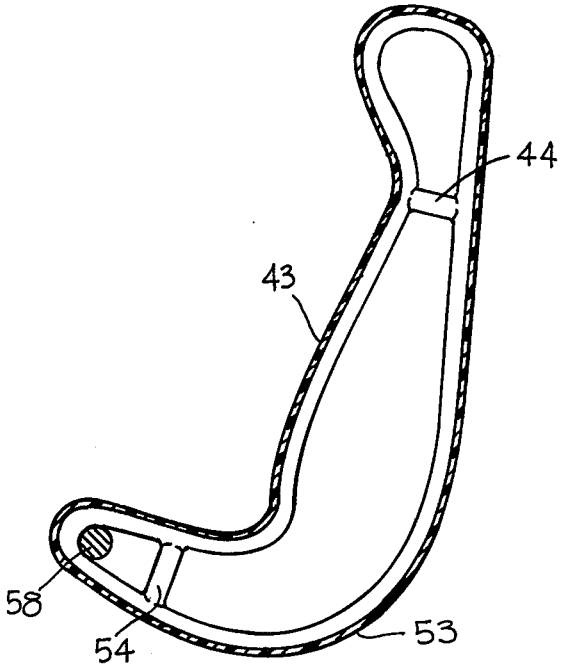
FIG. 4 is a side view of a first alternate embodiment of the apparatus of FIG. 1.
Figure 5:
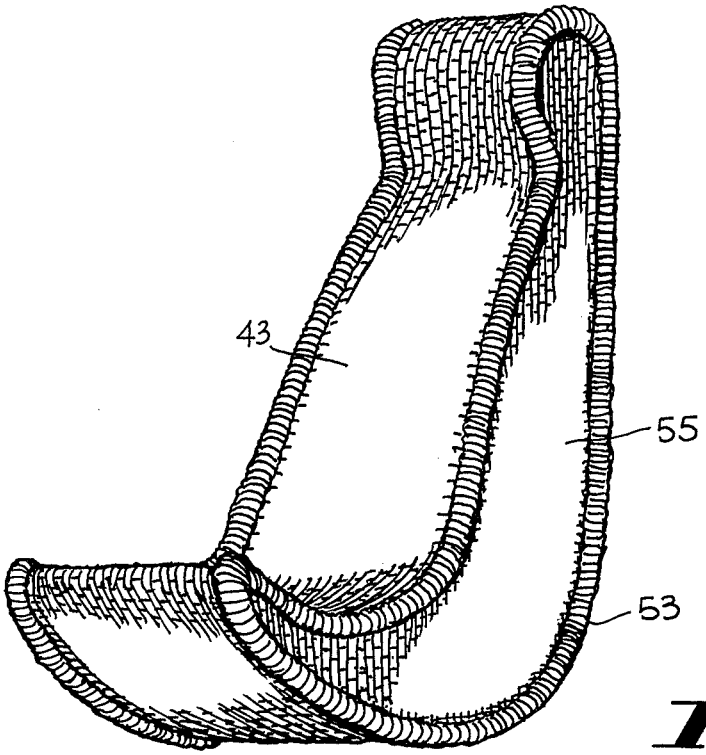
FIG. 5 is a perspective view of the apparatus shown in FIG. 4.

FIGS. 4 and 5 show an alternate construction of the apparatus of the present invention. The inner surface 43 and the outer surface 53 have been formed by a framework. Such a framework may be wood, such as bamboo, or metal, such as tubular aluminum. When the chair has such a frame, a wicker covering may be provided for body support. Braces 44 and 54 form a means for spacing the inner and outer surfaces at a desired distance, in lieu of the solid filler shown in FIG. 1.

In FIG. 5 the wicker cover may be seen more clearly. It will be understood that coverings need not be restricted to wicker material, but may be naugahyde, leather or other natural or synthetic fabrics which have sufficient strength for supporting the human body and are known to those skilled in the art. In each instance, a balancing means 58 such as the metal weights previously described is placed in the forward portion or nose of the chair, proximate the location where legs of a user of the chair would hang over the chair.

Resilient padding may be sheathed with a cover which serves the purpose of protecting the resilient padding 26. Again, the cover is not a functionally necessary portion of this present invention but adds to the durability and appearance of the chair. In this embodiment the cover is made of naugahide, but any suitable fabric or material that would serve a protective purpose may be used. The cover may be fastened to main body 10 by snap fasteners.

Figure 6:
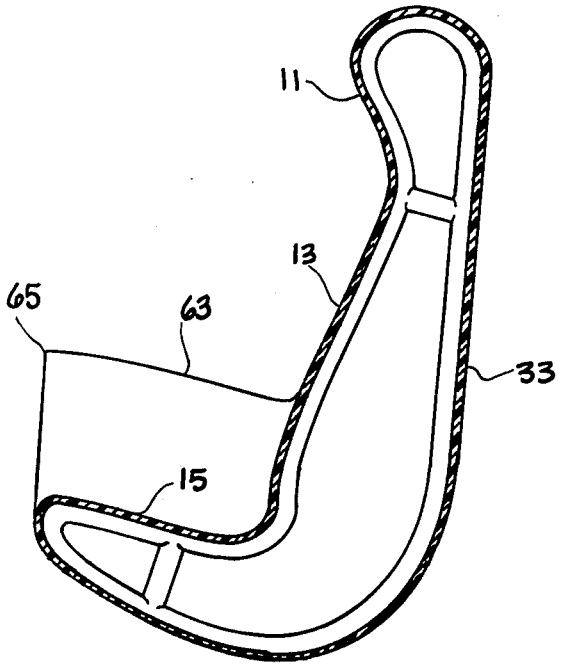
FIG. 6 is a side view of a second alternate embodiment of the chair of FIG. 1.
Figure 7:
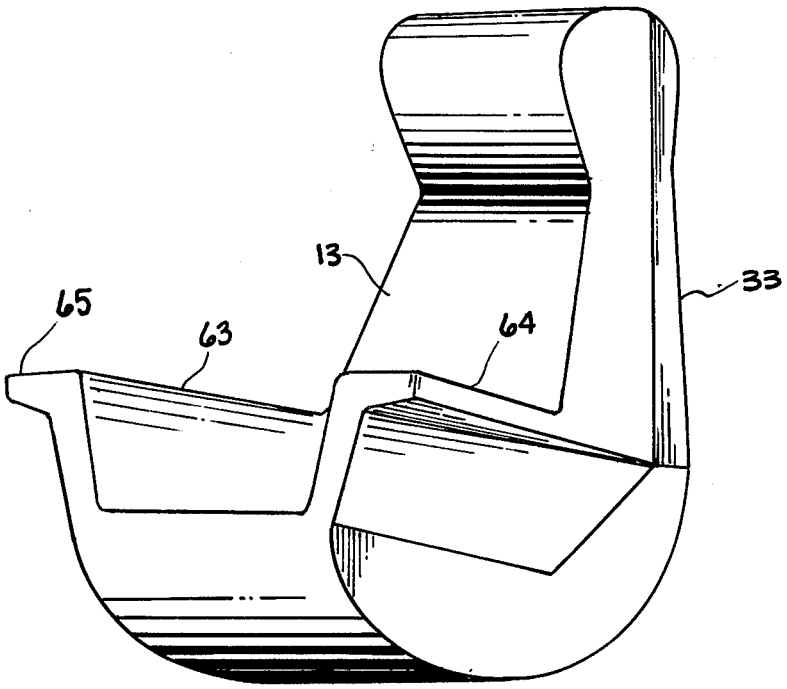
FIG. 7 is a perspective view of the chair of FIG. 6.

In FIGS. 6 and 7 an alternate embodiment of the chair of the present invention is shown. Previously, it was stated that the balancing means of the chair may be a weight in the nose of the chair. This may be accomplished by placing a weight inside of the seat, as shown in FIGS. 1, 2 and 3. Another way to place weight in the nose of the chair is external to the seat. A convenient place to place such weight is in the arms of a chair. Although arms have weight distributed along their length, they add weight to the forward portion of the seat, especially where they are supported therefrom. Additionally, supplementary weights may be buried inside the forwardmost portion of the arms. The arms should extend forwardly for adding weight to the nose of the chair, but no particular forward location is critical.

In FIG. 6 arm 63 is seen to extend forwardly, generally coextensive in length with seat supporting region 15. The most forward portion of this seat supporting region is the nose of the chair and arm 63 may extend beyond the most forward portion of the seat or slightly rearward of it. Arms 63, 64 may be made of material which is heavier than the remainder of the chair, such as dense plastic, hard rubber or plaster of Paris. The arms may be flared outwardly, away from the chair seat, near the chair nose to provide extra weight there.

The important consideration is that the arms 63, 64 place sufficient weight in the nose of the chair that the chair will stand upright, as shown in FIG. 6, when not in use. However, the weight will allow reclining when a user sits in the chair and pushes the chair back with his legs to a desired reclining position. While chairs of the prior art may have had weights in the bases of the chairs for bringing the chairs to an upright position, none is known to have a balancing means which permits a user to recline as far back as he desires and brings the chair to an upright position when the user alights. In this sense the balancing means is a slight counterbalance against the weight of a user.

When the chair is being used on a flat, regular surface the user simply seats himself in seat depression 15, leans back onto back supporting area 13 and rests his head against headrest 11. The user may rock the chair by making gentle upper torso movements or by bracing his feet against the floor or an ottoman and flexing his legs. Nearly effortless reclining is possible by bracing or resting his feet against the floor, an ottoman or other relatively stationary objects.

When being used as a floating chair the user seats himself in the normal manner. The chair will assume a balanced position on the water. The chair may then be rocked by slight upper torso motions by the user or the user may simply allow the waves to impart a gentle rocking motion to the chair.

In the embodiments of FIGS. 1, 2 and 3 and FIGS. 4 and 5 and FIGS. 6 and 7 an inner chair surface is shown to be spaced apart from an arcuate outer surface. Both surfaces have lengths which are coextensive and joined together, both at the chair apex or tip of the head region, as well as at the most forward tip of raised area 17. In all embodiments a frame spaces the inner surface from the outer surface. In the first and third embodiments a solid filler material serves as a frame means, whereas in the second embodiment a tubular frame spaces the inner chair surface from the outer chair surface, forming a frame means. In all cases a legless rocking chair is provided which is lightweight, easy to use and stands in an upright position when not in use.

The chair of the present invention may be made as previously described. High impact plastic foams, such as styrene or urethane, are preferred, with a hard shell finish characterizing the finished molded chair.

I claim:

1. A legless rocking and reclining chair comprising, an inner chair surface having a contour for supporting the back and seat of a seated person, an arcuate outer surface having a length generally coextensive with said inner surface, but spaced apart from the inner surface, and connected thereto forming a closed chair body, said inner and outer chair surfaces having a smooth curvature along the length thereof, said surfaces defined by a generally upright portion generally corresponding in length, width and curvature to the back of a seated person and a smoothly curved seat portion connected to the upright portion corresponding in length, width and curvature to the seat of a seated person, for reclining to an angle such that the back of a seated person may exceed 60° with respect to the vertical, frame means for spacing said inner surface from said outer surface with maximum spacing at opposite sides of the width of the chair surfaces at least in the seat portion, said chair surfaces having a forward section defining a nose and a rearward section defining a chair back, and balancing means in the nose of said chair body for maintaining said chair in a stable upright position when not in use.

2. The apparatus of claim 1 wherein said chair surfaces have chair arms projecting therefrom above the seat support region toward the nose of said chair, said balancing means residing in said chair arms.

3. The apparatus of claim 1 wherein said balancing means comprises a weight between said inner and outer surfaces in a seat support region of said chair.

4. The apparatus of claim 3 wherein said weight is a bar which traverses the width of said chair in said seat support region.

5. The apparatus of claim 1 wherein said balancing means is located proximate to said seat contour of said inner chair surface near its joinder with said outer surface.

6. The apparatus of claim 1 wherein said frame means comprises a filler material.

* * * * *

US004109960B1

REEXAMINATION CERTIFICATE (2340th)

United States Patent [19]

Stinchfield

[11] B1 4,109,960

[45] Certificate Issued Jul. 26, 1994

[54] LEGLESS ROCKER-RECLINER CHAIR

[76] Inventor: Lawrence M. Stinchfield, 539 Beverly Ave., Paso Robles, Calif. 93446

Reexamination Request:
No. 90/002,930, Jan. 8, 1993

Reexamination Certificate for:

| | |
|---|---|
| Patent No.: | **4,109,960** |
| Issued: | **Aug. 29, 1978** |
| Appl. No.: | **802,649** |
| Filed: | **Jun. 2, 1977** |

Related U.S. Application Data

[63] Continuation-in-part of Ser. No. 746,476, Dec. 1, 1976, abandoned.

[51] Int. Cl.[5] ..... A47C 3/02

[52] U.S. Cl. ..... 297/258; 297/411.2; 297/452.17; 297/452.2; 297/411.44; D6/348

[58] Field of Search ..... 297/258, 270, 272, 411.2, 297/452.17, 452.19, 452.20, 411.44

[56] References Cited

U.S. PATENT DOCUMENTS

| | | | |
|---|---|---|---|
| 2,482,306 | 9/1944 | Waldheim | 297/258 |
| 2,854,062 | 9/1958 | Hetchler | 297/258 |
| 3,526,429 | 9/1970 | Metzger | 297/258 |

FOREIGN PATENT DOCUMENTS

| | | | |
|---|---|---|---|
| 709453 | 8/1931 | France . | |
| 6712562 | 3/1968 | Netherlands | 297/258 |

*Primary Examiner*—Peter R. Brown
*Attorney, Agent, or Firm*—Thomas Schneck, Jr.

[57] ABSTRACT

A legless chair possessing an arcuate exterior permitting rocking and reclining. The arcuate surface contacts a floor for stability and reclining to a selected position. Weight in the nose of the chair brings the chair to an upright position when not in use. A lightweight filler material may be provided for buoyancy, easy portability and for use in water.

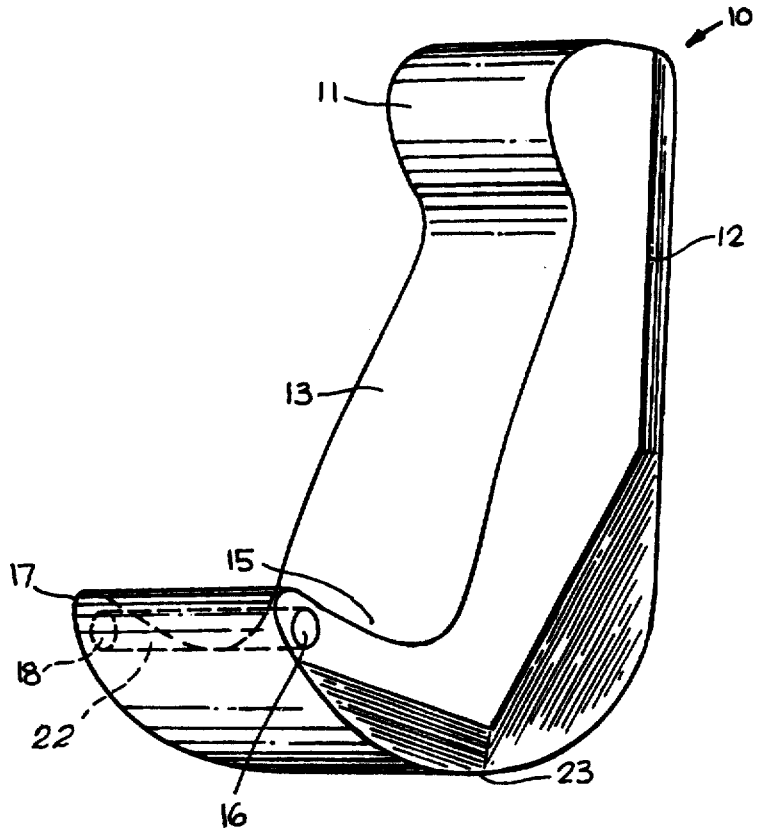

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *